US006174184B1

(12) United States Patent
Meng

(10) Patent No.: US 6,174,184 B1
(45) Date of Patent: Jan. 16, 2001

(54) CARD EDGE CONNECTOR

(75) Inventor: Ching-Chang Meng, Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/418,999

(22) Filed: Oct. 14, 1999

(30) Foreign Application Priority Data

Jun. 17, 1999 (TW) ..... 88210075

(51) Int. Cl.[7] ..... H01R 29/00
(52) U.S. Cl. ..... 439/188; 439/488; 439/681
(58) Field of Search ..... 439/188, 488, 439/489, 637, 681, 680

(56) References Cited

U.S. PATENT DOCUMENTS 3,576,519 * 4/1971 Janye et al. ..... 439/681
3,634,816 * 1/1972 Zell ..... 439/681
4,106,841 * 8/1978 Vladic .
4,307,927 * 12/1981 Mollman ..... 439/681
5,019,947 * 5/1991 Pelzl ..... 439/681
5,366,382 * 11/1994 Thumma ..... 439/188
5,387,132 * 2/1995 Sarver et al. ..... 439/681
5,688,147 * 11/1997 Coteus et al. ..... 439/681

* cited by examiner

*Primary Examiner*—Gary F. Paumen
(74) *Attorney, Agent, or Firm*—Wei Te Chung

(57) ABSTRACT

An electrical connector comprises an insulative housing defining a slot and a number of cavities, a number of conductive contacts and two pairs of switch terminals received in the corresponding cavities of the housing, a pair of metal sheets received in the housing and an insert. Each contact forms an engaging portion extending into the slot. Each switch terminal forms a connecting portion adapted for electrically connecting with the corresponding metal sheet. The insert is configured to disengage the connecting portions of one pair of the switch terminals from the corresponding metal sheet. The other pair of the switch terminals remains interconnected via the other metal sheet.

1 Claim, 10 Drawing Sheets

CARD EDGE CONNECTOR

BACKGROUND OF THE INVENTION

The present invention relates to a card edge connector, and particularly to a card edge connector adaptable for different operating configurations and voltages.

U.S. Pat. Nos. 4,106,841 and 5,366,382 each disclose a conventional card edge connector comprising an insulative housing and a plurality of conductive contacts secured in the housing. Each contact comprises an engaging portion having a connecting portion. The engaging portions of opposite contacts are interconnected at free ends thereof before a daughter card is mated with the connector. When the daughter card is mated with the connector, the daughter card abuts against the engaging portions of the contacts to separate the engaging portions of the opposite contacts from each other.

Referring to FIGS. 1 and 2, which illustrate the conventional card edge connector disclosed in U.S. Pat. No. 5,366,382, the card edge connector 100 comprises an insulative housing 90 and a plurality of contacts 91 received in the housing. Each contact 91 comprises an engaging portion 92. The engaging portion 92 forms a connecting portion 93 projecting toward an opposite contact 91 and a wedge 94 at a free end thereof. The wedges 94 of the opposite contacts 91 are laterally interconnected before a daughter card is mated with the card edge connector 100. However, since the engaging portions 92 are interconnected at free ends thereof, the contacts 91 must be manufactured with a high precision or else the engaging portions 92 cannot properly interconnect. Hence, an improved electrical connector is required to overcome the disadvantages of the prior art.

BRIEF SUMMARY OF THE INVENTION

An object of the present invention is to provide a universal card edge connector having switch terminals and an insert adapted for enabling the connector to have different working configurations and voltages whereby the connector can receive different kinds of daughter board. Another object of the present invention is to provide a card edge connector having switch terminals that are easily interconnected to reliably position at a normal close state.

An electrical connector comprises an insulative housing defining a slot and a number of cavities, a number of conductive contacts and two pairs of switch terminals received in the corresponding cavities of the housing, a pair of metal sheets received in the housing, and an insert. Each contact forms an engaging portion extending into the slot. Each switch terminal forms a connecting portion adapted for electrically connecting with the metal sheet. The insert is configured to disengage the connecting portions of one pair of the switch terminals from the corresponding metal sheet.

The housing defines two pairs of cutouts in a top face thereof and recesses communicated with the corresponding cutouts in inner faces of walls thereof. The insert comprises a main portion and a pair of wings laterally extending from an end of the main portion. Each wing comprises a neck and an expanding portion. The main portion defines a pair of recessed surfaces in opposite faces thereof. The necks are secured in the corresponding cutouts of the housing and the expanding portions abut against opposite outside surfaces of the housing to secure the insert to the housing. The recessed surfaces of the insert abut against the spring arms of the switch terminals to disengage the connecting portions from the corresponding metal sheet, whereby the switch terminals are shifted from a normal close state to an open state.

Other objects, advantages and novel features of the invention will become more apparent from the following detailed description of the present embodiment when taken in conjunction with the accompanying drawings.

DETAILED DESCRIPTION OF THE INVENTION

Figure 1:
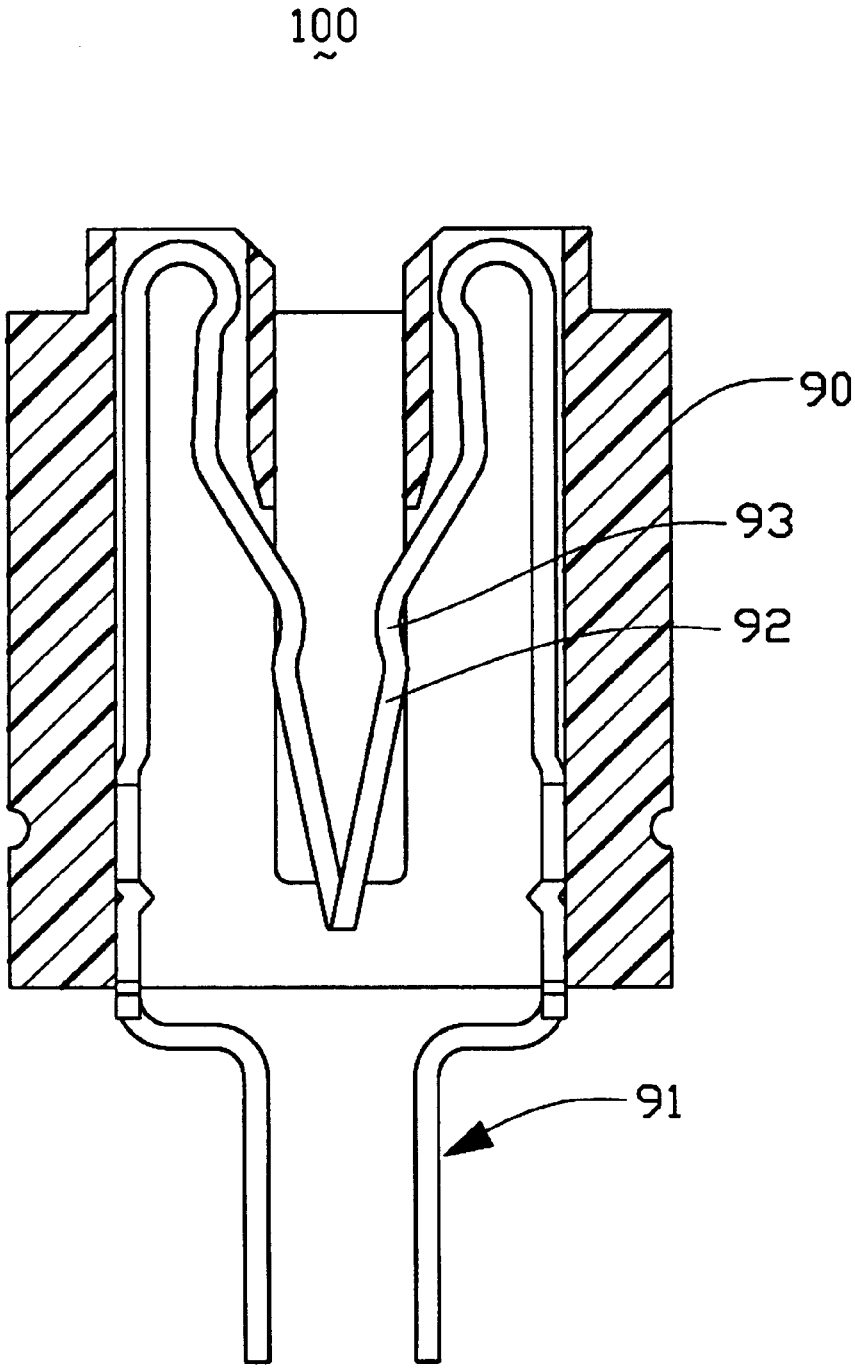
FIG. 1 (PRIOR ART)
FIG. 1 is a cross-sectional view of a conventional card edge connector.
Figure 2:
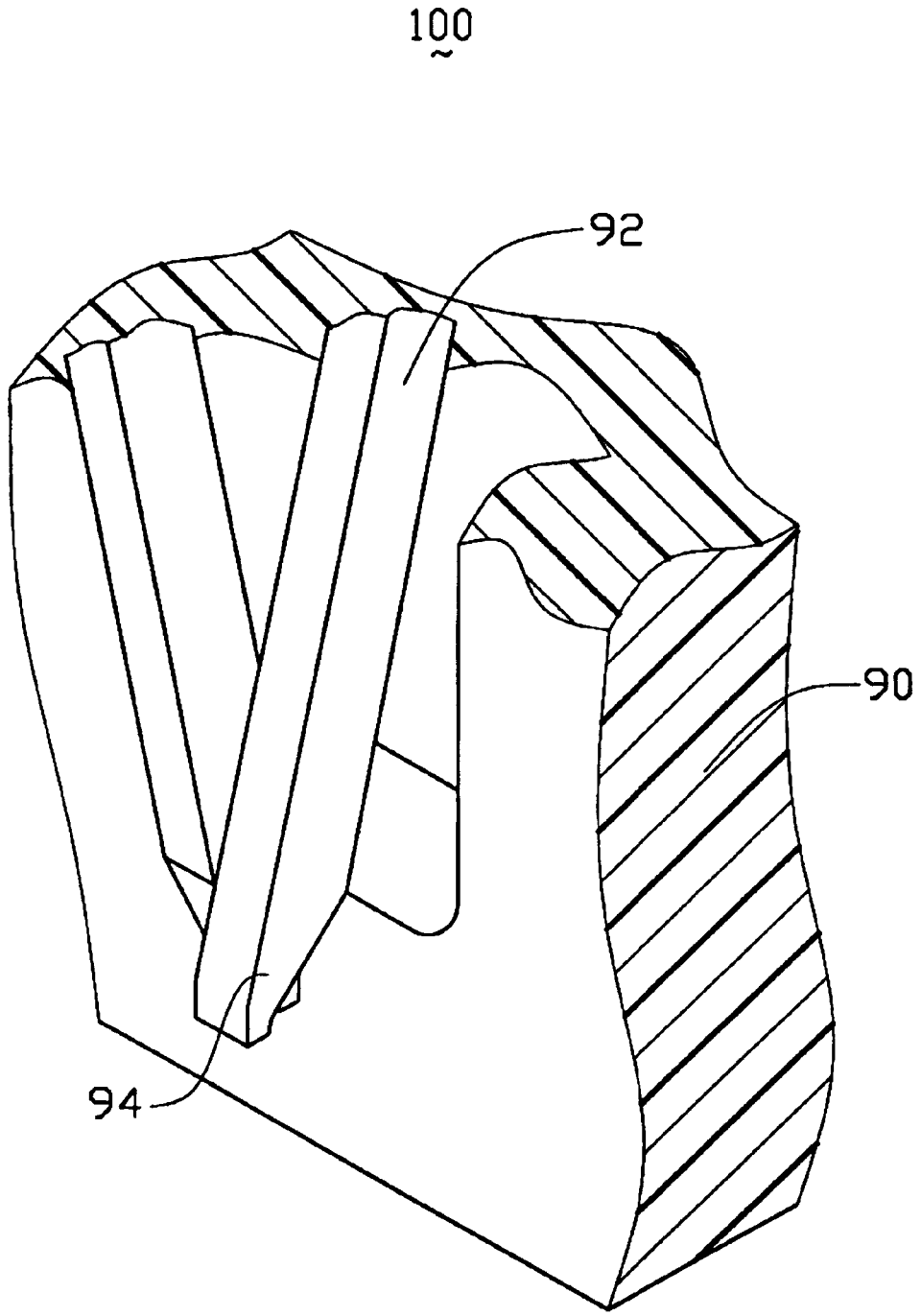
FIG. 2 (PRIOR ART)
FIG. 2 is a partial, enlarged, perspective view of the conventional connector of FIG. 1.
Figure 3:
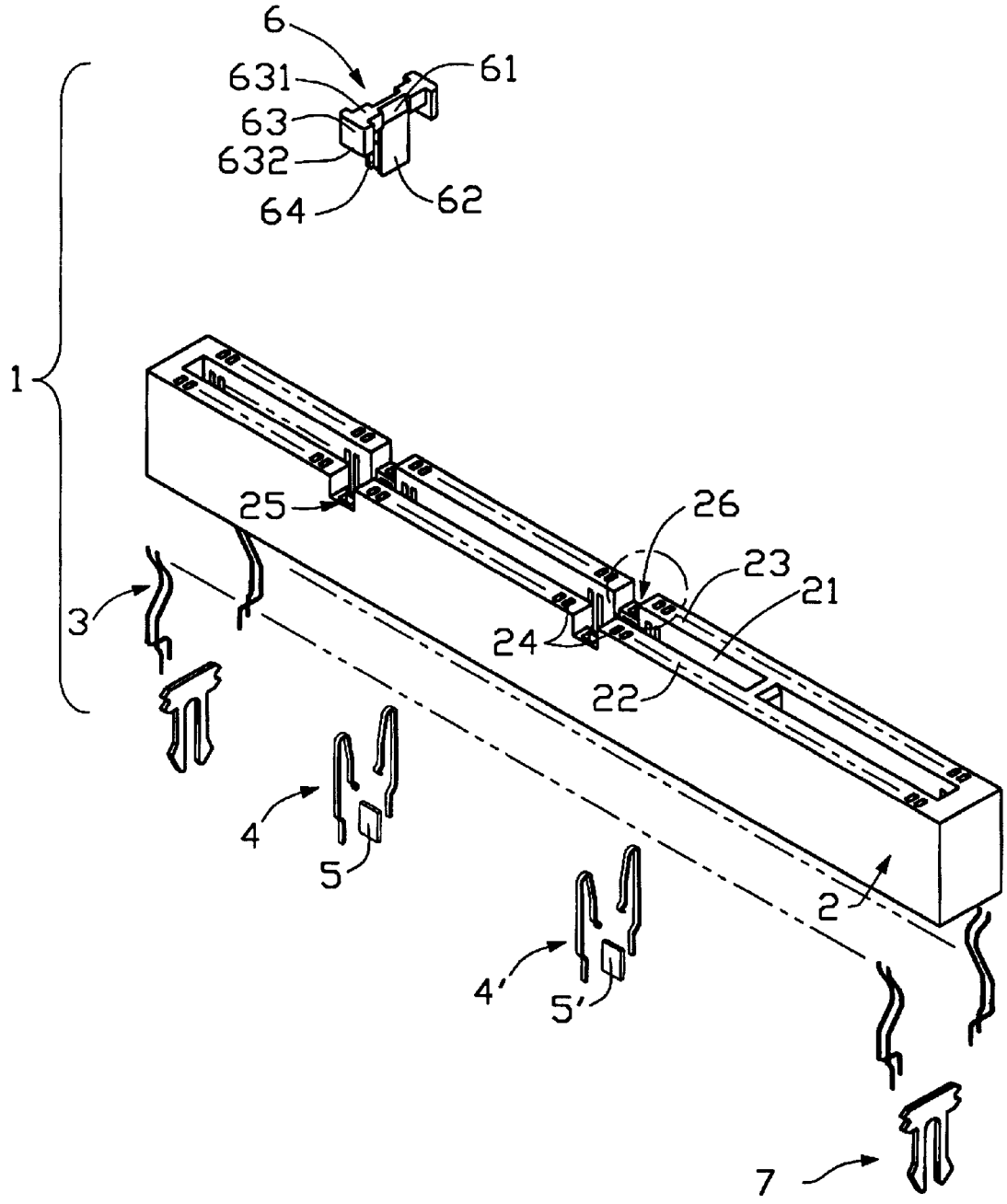
FIG. 3 is an exploded view of a card edge connector in accordance with the present invention.
Figure 3A:
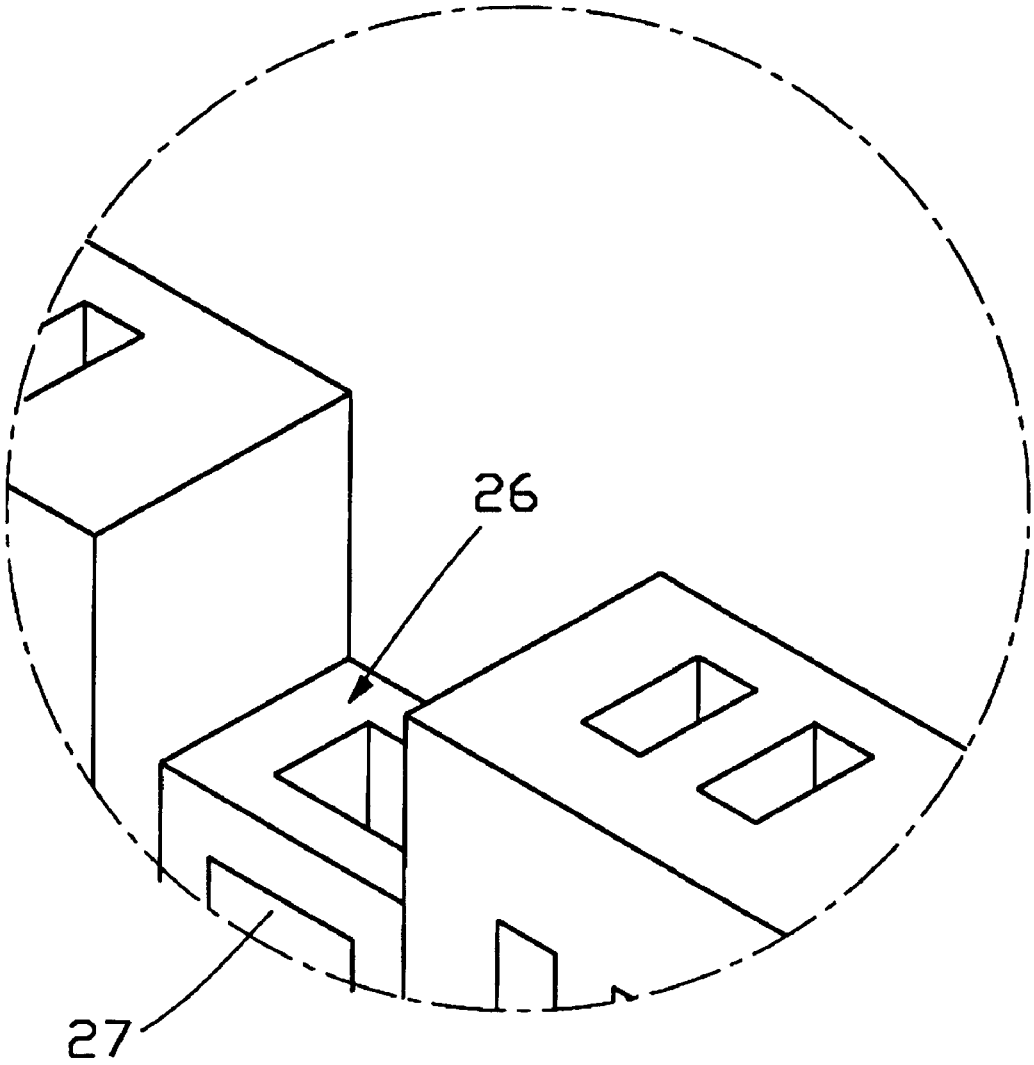
FIG. 3A is an enlarged view of a portion of FIG. 3 indicated by a circle.
Figure 4:
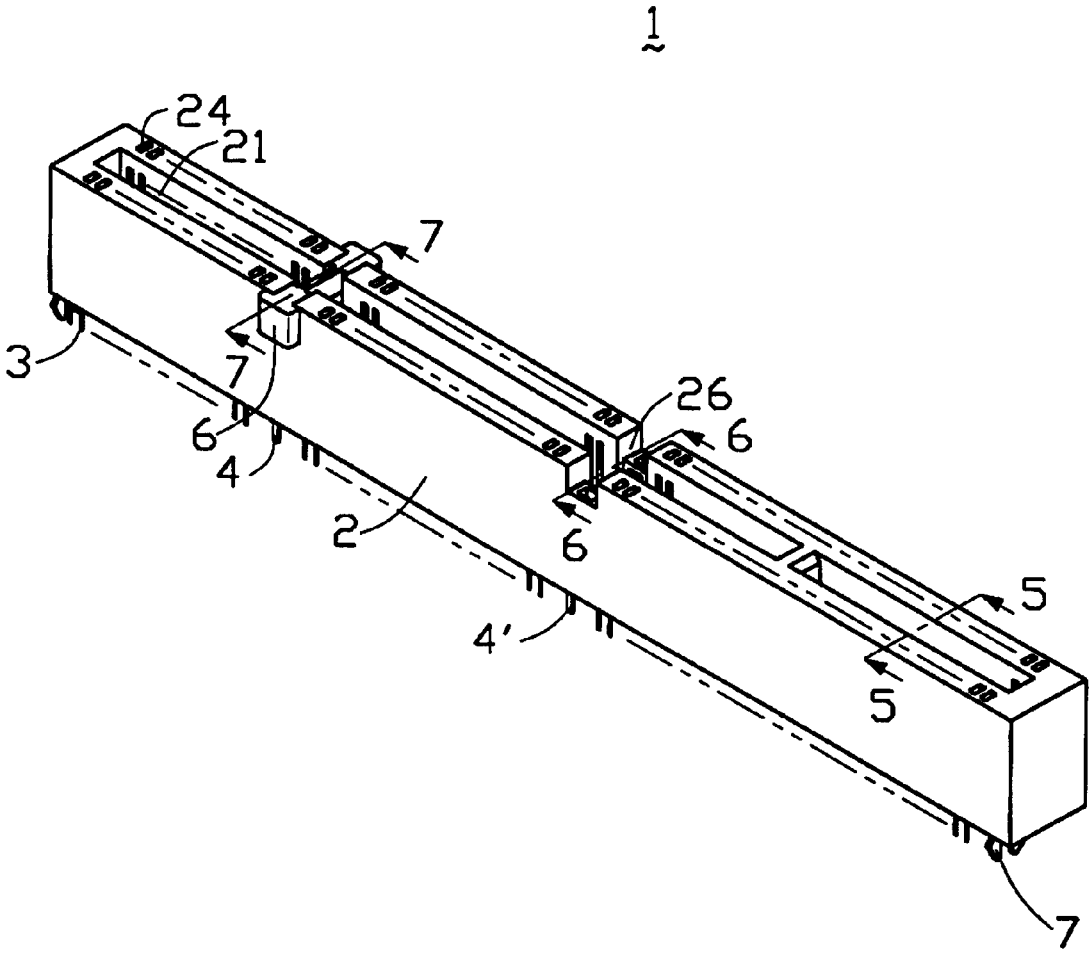
FIG. 4 is an assembled view of FIG. 3.
Figure 5:
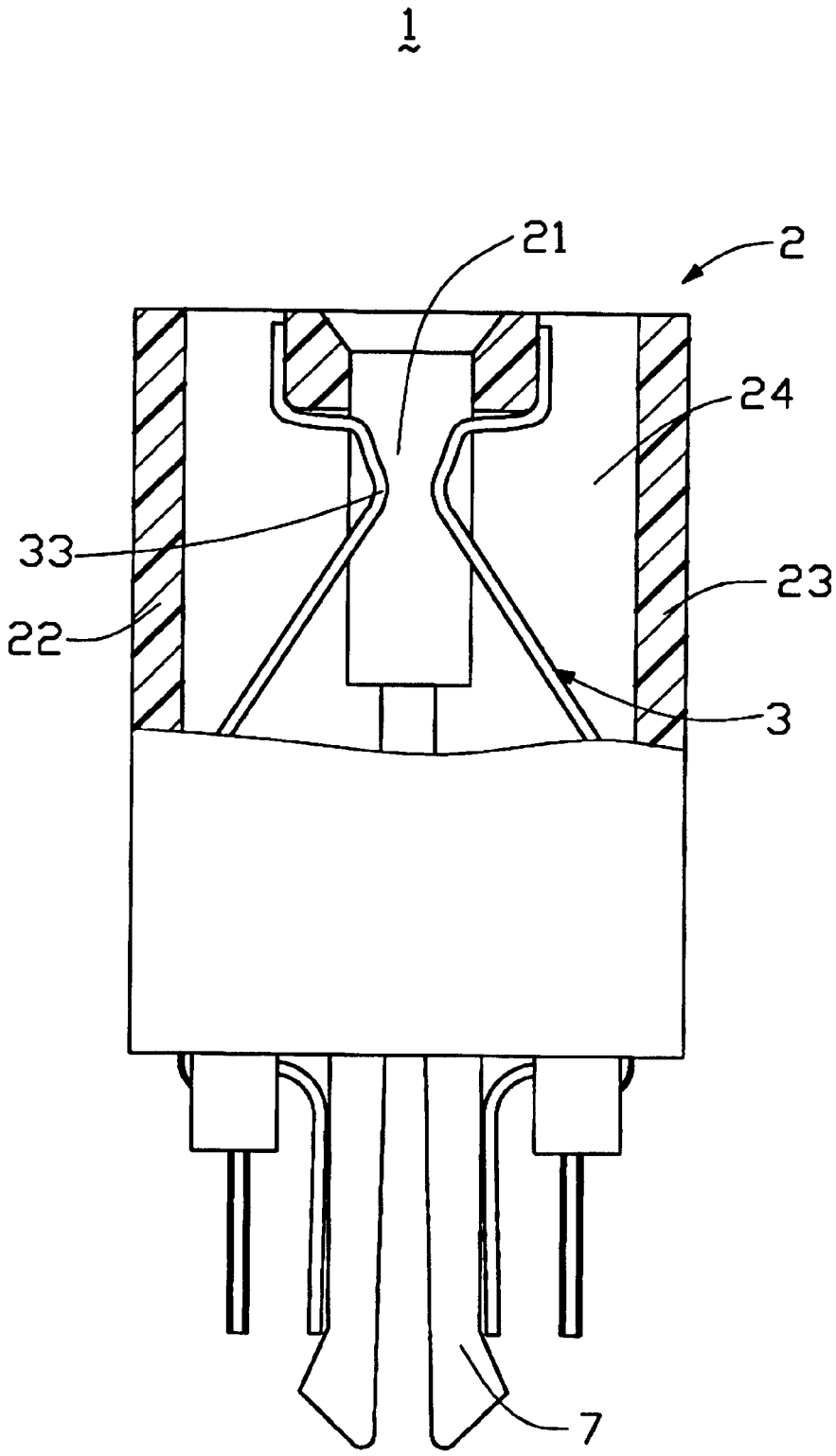
FIG. 5 is a partially cross-sectional view taken along line 5—5 of FIG. 4.
Figure 6:
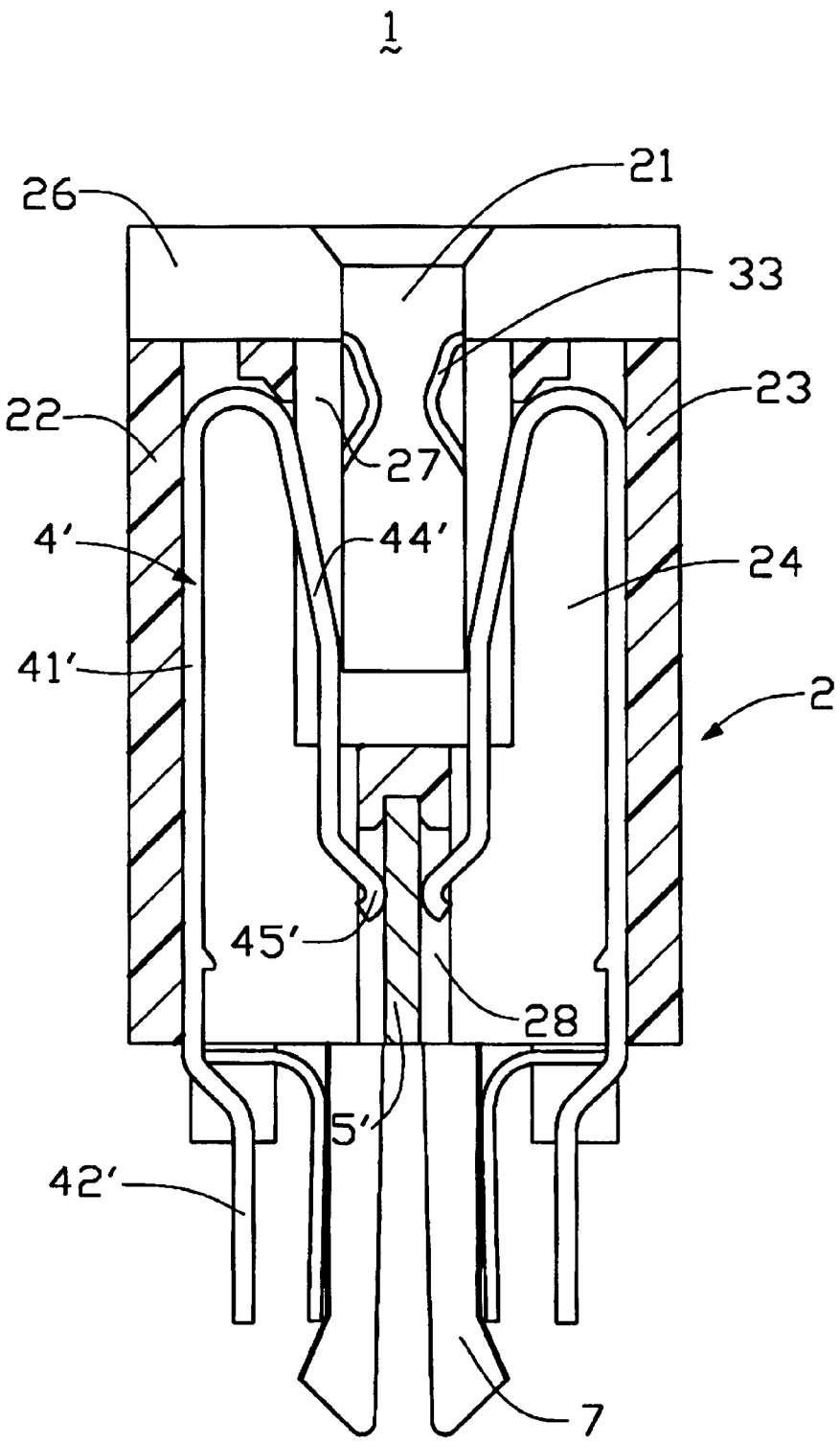
FIG. 6 is a cross-sectional view taken along line 6—6 of FIG . 4.

Referring to FIGS. 3–6, a card edge connector 1 in accordance with the present invention comprises an insulative housing 2, a plurality of conductive contacts 3, two pair of switch terminals 4, 4', two metal sheets 5, 5', an insert 6 and two board locks 7. The housing 2 comprises a pair of walls 22, 23 and a slot 21 defined between the walls 22, 23. Each wall 22 (23) defines a plurality of cavities 24 therethrough communicating with the slot 21. The housing 2 further defines two pairs of aligned cutouts 25, 26 in a top face thereof and two pairs of recesses 27 (FIG. 3A) respectively communicating with the cutouts 25, 26 in inner surfaces of the walls 22, 23. The housing 2 also defines a space 28 (FIG. 6) laterally communicating with the cavities 24 below each pair of the cutouts 25, 26. The metal sheets 5, 5' are secured in the corresponding spaces 28. The contacts 3 are received in the corresponding cavities 24 of the housing 2 with engaging portions 33 thereof projecting into the slot 21.

Each switch terminal 4 (4') is stamped and formed from a metal plate to form a retention portion 41 (41 '), a spring arm 44 (44') oppositely bent from the retention portion 41 (41'), and a connecting portion 45 (45') extending from an end of the spring arm 44 (44') in a direction away from the retention portion 41 (41'). The connecting portion 45 (45') is curved at a free end thereof to electrically contact with the metal sheet 5 (5'). Each switch terminal 4 (4') forms a mounting tail 42 (42') which is offset from the retention portion 41 (41') for being electrically mounted to a printed circuit board (not shown). The switch terminals 4 (4') are received in the cavities 24 which communicate with the cutouts 25 (26), and the connecting portions 45 (45') of the switch terminals 4 (4') are reliably connected with the metal sheet 5 (5').

The insert 6 comprises a main portion 62 and a pair of wings 63 laterally extending from an end of the main portion 62. The main portion 62 forms a tapered portion 61 at the end from which the wings 63 extend for facilitating insertion of a daughter card 8. (FIG. 8) into the slot 21. The main portion 62 defines a pair of recessed surfaces 64 in opposite side faces thereof. Each wing 63 comprises a neck 631 and an expanding portion 632. The necks 631 are secured in the corresponding cutouts 25 (26) whereby the expanding portions 632 reliably abut against opposite outside surfaces of the housing 2 and opposite edges of the main portion 62 are received in the recesses 27 of the walls 22, 23 to secure the insert 6 in the housing 1. The board locks 7 are upwardly assembled to the housing 2 with interfering portions (not labeled) thereof securely engaging with the housing 2.

Figure 7:
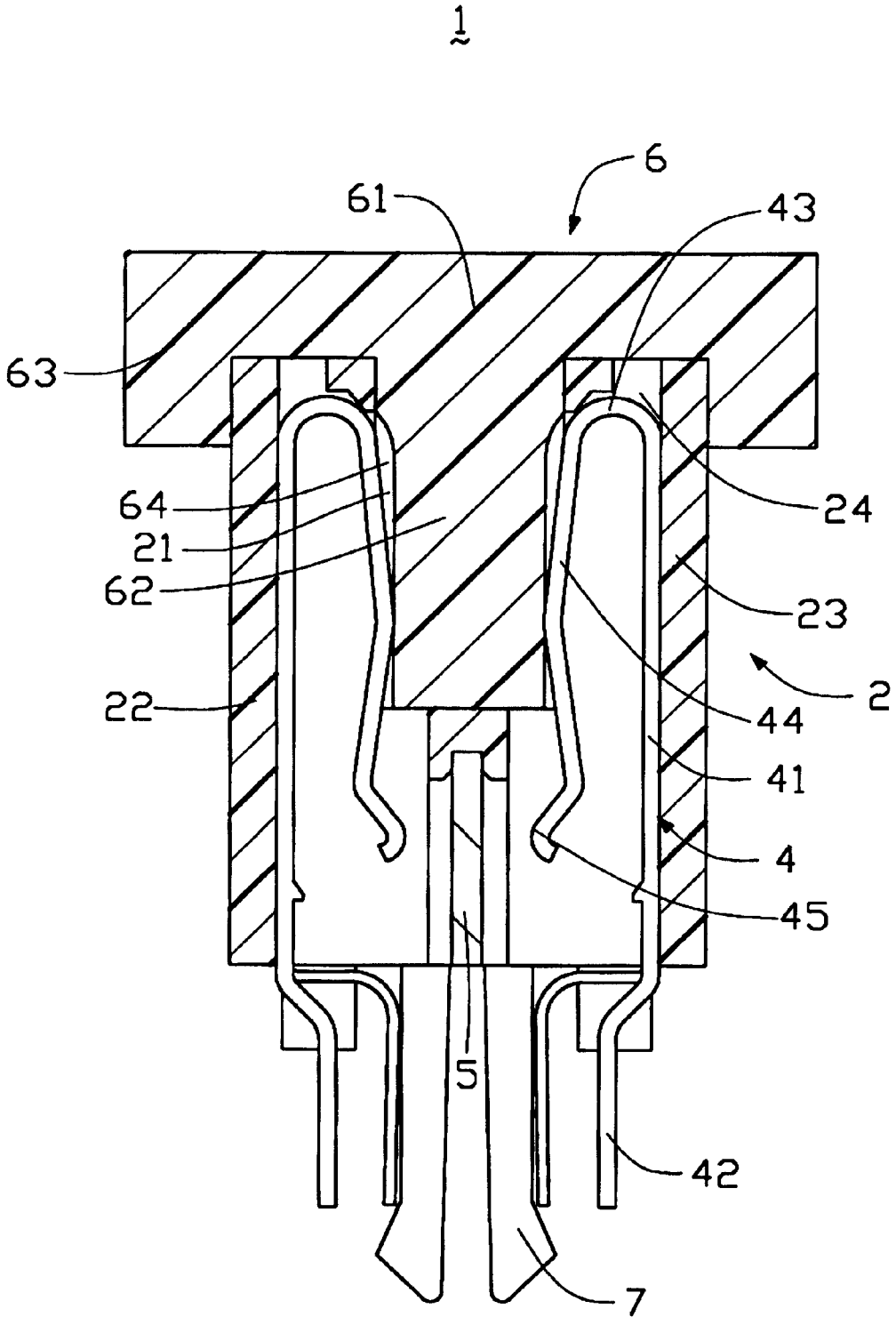
FIG. 7 is a cross-sectional view taken along line 7—7 of FIG. 4.
Figure 8:
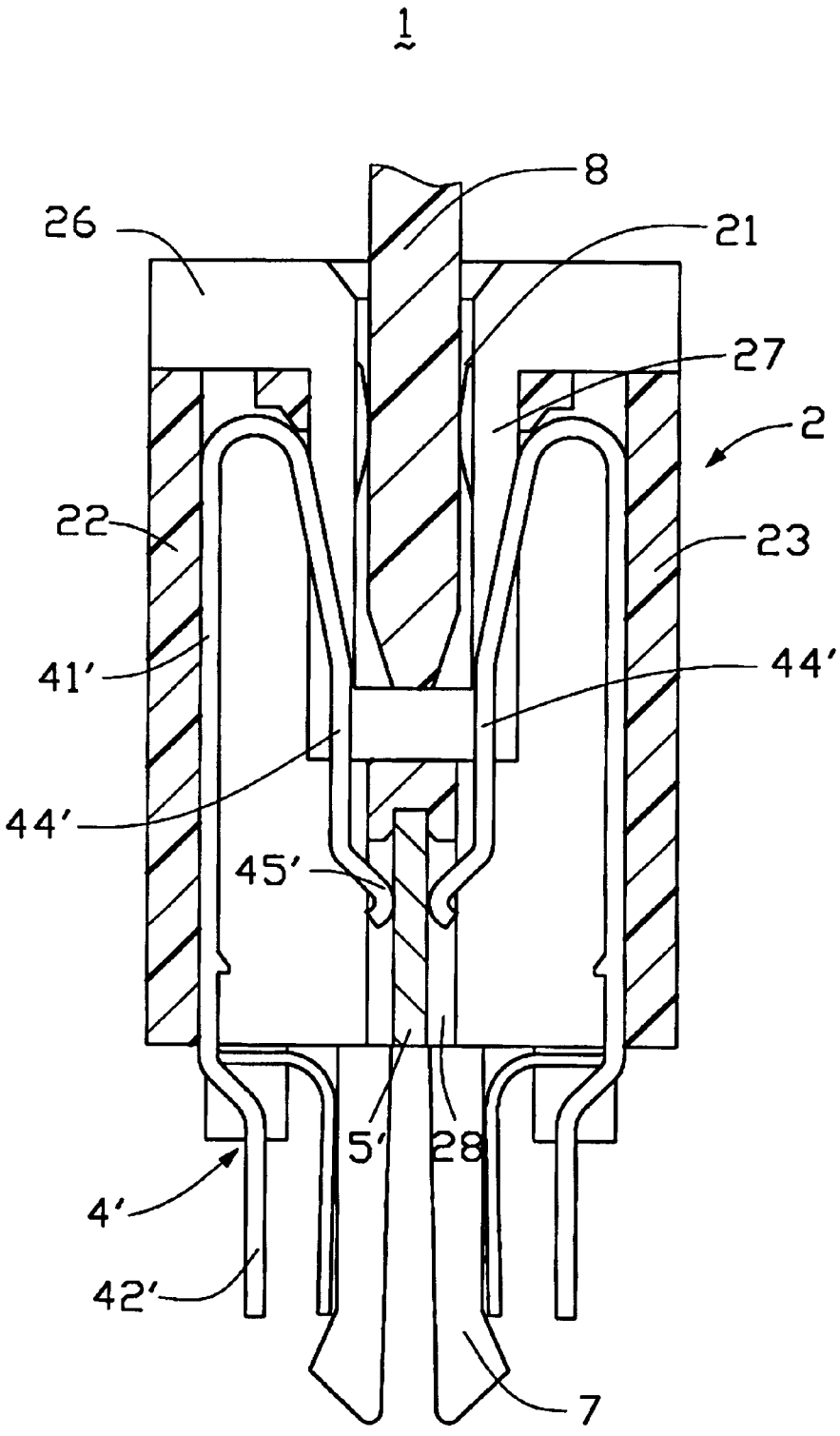
FIG. 8 is a view similar to FIG. 6 but with a daughter card inserted in the card edge connector.
Figure 9:
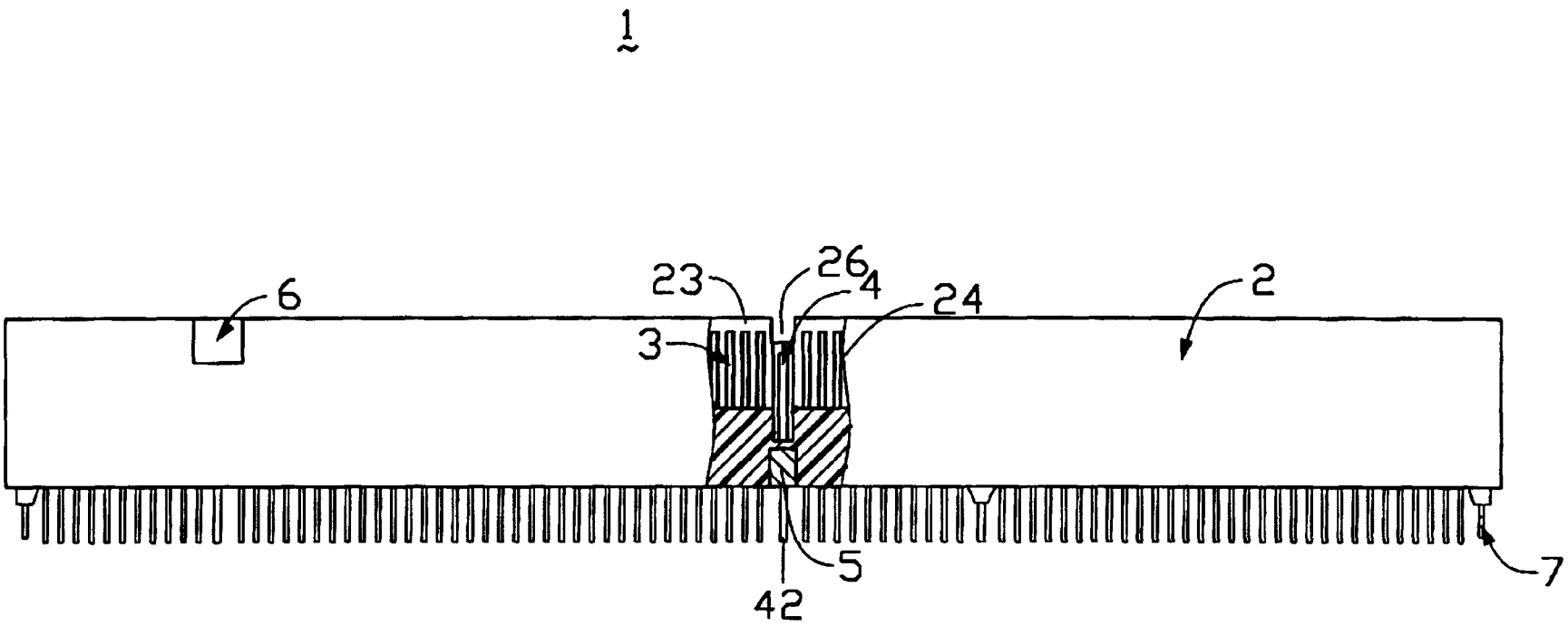
FIG. 9 is a partially cut-away front view of the card edge connector in accordance with the present invention.

Referring to FIGS. 7–9, when the insert 6 are inserted into the cutouts 25 of the housing 2, the recessed surfaces 64 of the main portion 62 abut against the spring arms 44 of the switch terminals 4 to disengage the connecting portions 45 from the metal sheet 5, whereby the switch terminals 4 are shifted from a normal close state to an open state. The switch terminals 4' remain at a close state 5'; thus, a first working configuration with a first working voltage is applied to the connector to make it suitable for receiving a first type of daughter board. On the other hand, when the insert 6 is withdrawn from the cutouts 25 and inserted into the cutouts 26 of the housing 2, the connector is changed to a second working configuration with a second working voltage suitable for receiving a second type of daughter board.

It can be contemplated that the positions of the pair of switch terminals 4(4') along the housing 2 comply with the differently positioned notches (not shown but well known) in the bottom edge portion of the different daughter boards which are designed for different voltage usage. Also, the insert 6 is configured and dimensioned to be adapted to be received within the notch of each different daughter board. Therefore, to install the insert 6 between either of said pairs of switch terminals 4(4'), not only electrically actuates the corresponding pair of switch terminals 4(4') to assure the specific voltage may be provided with the connector but also mechanically cooperates with the notch of the daughter board to assure that only such a specific voltage daughter board can be inserted into the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting a daughter card to a printed circuit board, comprising:

an insulative housing including a top face and a bottom face and defining a slot and a plurality of cavities, the housing defining a pair of parallel cutouts in the top face thereof and two recesses in opposite peripheral walls of the slot, each recess communicating with a selected cutout, each cutout communicating with the corresponding cavity, the housing defining a space in the bottom face thereof opposing the cutouts, the space communicating with the slot;

a plurality of conductive contacts received in the corresponding cavities of the housing with engaging portions thereof projecting into the slot;

a metal sheet received in the space of the housing;

a pair of switch terminals each having a connecting portion, the switch terminals being received in the cavities communicating with the cutouts, the connecting portions being electrically connected with the metal sheet, the switch terminals being unconnected when the daughter card is mated with the connector; and an insert partially received in the cutouts of the housing for spacing the connecting portions of the switch terminals from the metal sheet;

wherein each switch terminal comprises a retention portion, a spring arm oppositely extending from the retention portion and the connecting portion projecting in a direction away from the retention portion;

wherein the insert comprises a main portion and a pair of wings laterally extending from an end of the main portion, each wing comprising a neck and an expanding portion, wherein the necks are secured in the cutouts of the housing and the expanding portions abut against opposite outside faces of the housing to secure the insert in the housing;

wherein the main portion defines a pair of recessed surfaces in opposite faces thereof, the recessed surfaces abutting against the spring arms of the switch terminals to disengage the connecting portions from the metal sheet.

* * * * *